US005332644A

United States Patent [19]

McNamara

[11] Patent Number: 5,332,644

[45] Date of Patent: Jul. 26, 1994

[54] CHARGE GENERATOR LAYERS FORMED BY POLYMERIZATION OF DISPERSION OF PHOTOCONDUCTIVE PARTICLES IN VINYL MONOMER

[75] Inventor: Robert McNamara, Rochester, N.Y.

[73] Assignee: Xerox Corporation, Stamford, Conn.

[21] Appl. No.: 965,049

[22] Filed: Oct. 22, 1992

Related U.S. Application Data

[63] Continuation of Ser. No. 634,587, Dec. 27, 1990, abandoned.

[51] Int. Cl.[5] ..... G03G 5/05

[52] U.S. Cl. ..... 430/134; 430/133; 430/135; 430/78

[58] Field of Search ..... 430/56–59, 430/127, 133, 134, 135; 252/501.1

[56] References Cited

U.S. PATENT DOCUMENTS

| | | | |
|---|---|---|---|
| 3,625,747 | 12/1971 | Kaneko et al. | 430/135 |
| 3,948,657 | 4/1976 | Yoshikawa | 430/57 |
| 4,302,522 | 11/1981 | Garnett | 430/133 |
| 4,358,519 | 11/1982 | Chang | 430/2 |
| 4,443,528 | 4/1984 | Tamura | 430/66 X |
| 4,587,189 | 5/1986 | Hor et al. | 430/59 |
| 4,877,709 | 10/1989 | Inoue et al. | 430/128 |
| 4,882,254 | 11/1989 | Loutfy et al. | 430/59 |
| 5,028,503 | 7/1991 | Chang | 430/56 |
| 5,034,296 | 7/1991 | Ong et al. | 430/59 |

OTHER PUBLICATIONS

J. Pacansky, R. J. Waltman, H. Coufal, and R. Cox, "The Fabrication of Organic Layered Photoconductors Via Radiation Curing", pp. 6–32.

*Photopolymerization of Surface Coatings*, C. G. Roffey, John Wiley & Sons, Chichester, p. 110 1982.

*Primary Examiner*—Christopher Rodee

*Attorney, Agent, or Firm*—Kenyon & Kenyon

[57] ABSTRACT

A process for preparing an electrophotographic imaging member having a coating of photoconductive particles dispersed in a polymerizable film forming monomer, which when polymerized forms a charge generating layer.

6 Claims, 2 Drawing Sheets

CHARGE GENERATOR LAYERS FORMED BY POLYMERIZATION OF DISPERSION OF PHOTOCONDUCTIVE PARTICLES IN VINYL MONOMER

This application is a continuation of application Ser. No. 07/634,587, filed on Dec. 27, 1990 now abandoned.

BACKGROUND OF THE INVENTION

In electrophotography, an electrophotographic imaging member (i.e., a photoreceptor) is comprised of a stack of typically three or more coatings on a substrate of plastic, or metal. The configuration typically comprises a conductive layer (if the substrate is not metal and/or otherwise an inherently conductive material) on the substrate; a semi conductive and/or charge blocking layer; a generator layer of a photoconductive substance such as selenium and/or selenium alloys, pigments, ZnO, sulfur compounds and others either coated neat or in a polymeric binder; and a polymeric transport layer containing a hole or electron conductive compound that is soluble in the dried polymer coating, i.e. it is a clear homogeneous coating with no apparent crystals of the conductive compound. The device is charged with a high voltage corona, exposed to light reflected off of a document either through a lens or to a laser scanning apparatus that dissipates the charge in the white or background areas to form a positive latent mirror image of the document on the surface of the imaging member. The latent image is then developed with a marking material or toner particles in the approximate size range of 8 to 10 microns that have an opposite charge and are therefore attracted to the latent image. The resulting visible image is transferred from the device to a support such as paper or plastic. This imaging process takes place in seconds or fractions of a second and may be repeated thousands or even hundreds of thousands of times for the life of the device.

An electrophotographic imaging member may have a number of forms. For example, the imaging member may be a homogeneous layer of a single material such as vitreous selenium or may be a composite layer containing a photoconductor and another material. One type of composite imaging material comprises a layer of finely divided particles of a photoconductive inorganic compound dispersed in an electrically insulating organic resin binder. U.S. Pat. No. 4,265,990 discloses a layered photoreceptor having separate photogenerating and charge transport layers. The photogenerating layer is capable of generating positive holes when exposed to light and injecting them into the transport layer that relieves the electrons and/or net negative charge on the surface.

Other composite imaging members have been developed having numerous layers which are highly flexible and exhibit predictable electrical characteristics within narrow operating limits to provide excellent images over thousands of cycles. One type of multilayered photoreceptor that has been employed as a belt in electrophotographic imaging systems comprises a substrate, a conductive layer, a positive hole blocking layer, an adhesive layer, a charge generating layer, and a transport layer. This type of photoreceptor may also comprise additional layers such as an anti-curl back coating and an overcoating layer. It may also require additional adhesive layers or as is the case of the examples in this application require no adhesive layers.

A common type of photoreceptor has a suitable charge generating (photogenerating) layer applied to a charge blocking layer and/or an adhesive layer in between if there is poor adhesion of the photogenerator to the charge blocking layer. Additional layers of adhesives are not the most ideal configuration since they mean another step in manufacturing and they do add indiscriminate charge insulation, thus reducing the overall efficiency of the photoreceptor; however, in many cases such layers are required for the structural integrity of the stack. Examples of photogenerating layers include inorganic photoconductive materials such as amorphous selenium, trigonal selenium, selenium alloys selected from a group consisting of selenium-tellurium, selenium-tellurium-arsenic and selenium arsenide, phthalocyanine pigments such as the X-form of metal free phthalocyanine described in U.S. Pat. No. 3,356,989, metal phthalocyanines such as vanadyl phthalocyanine and copper phthalocyanine, dibromoanthanthrone, squarylium, quinacridones [available from Du Pont under the tradename Monastral Red, Monastral Violet, and Monastral Red Y, and Vat orange 1, and Vat orange 3 (tradenames for dibromo anthanthrone pigments)], benzimidazole perylene, substituted 2,4-diamino-triazines as disclosed in U.S. Pat. No. 3,442,781, and polynuclear aromatic quinones (available from Allied Chemical Corporation under the tradename Indofast Double Scarlet, Indofast Violet Lake B, Indofast Brilliant Scarlet and Indofast Orange). The particles are generally dispersed into a film forming polymeric binder dissolved in a suitable solvent and/or mixture of solvents. Making a good dispersion is in itself no trivial matter. The common methods of mechanical milling do not always afford good particle size and/or distribution in the submicron range. The method of milling employed may create deleterious properties such as increased dark decay increasing as a function of milling time; flocculation of the pigment particles due to solvent and/or polymer; a fast settling dispersion that is difficult to coat before it separates even under agitation; or pigment that is partially soluble in the solvent resulting in recrystallization which causes unacceptable diverse particle size distribution, etc.

Multi-photogenerating layer compositions may be utilized where a layer enhances or reduces the properties of the photogenerating layer. Examples of multi-photogenerating layer image members are described in U.S. Pat. No. 4,415,639. Other suitable photogenerating materials known in the art may also be utilized. Charge generating layers comprising a photoconductive material such as vanadyl phthalocyanine, metal free phthalocyanine, benzimidazole perylene (BZP), amorphous selenium, trigonal selenium, selenium alloys such as selenium-tellurium, selenium-tellurium-arsenic, selenium arsenide, and mixtures thereof, are especially preferred for their sensitivity to white light. Vanadyl phthalocyanine, metal free phthalocyanine and tellurium alloys are also preferred because these materials are also sensitive to infrared light.

Any suitable polymeric film forming binder material may be employed as the matrix in the photogenerating binder layer. Typical polymeric film forming materials include those described in U.S. Pat. No. 3,121,006.

The photogenerating composition or pigment is present in the resinous binder composition in various amounts. Generally from about 5% by volume to about 90% by volume of the photogenerating pigment is dispersed in about 10% by volume to about 95% by volume of the resinous binder. Preferably, from about 20% by volume to about 30% by volume of the photogenerating pigment is dispersed in about 70% by volume to about 80% by volume of the resinous binder composition.

The photogenerating layer generally ranges in thickness from about 0.1 micrometer to about 5.0 micrometers, preferably from about 0.3 micrometers to about 3.0 micrometers. The photogenerating layer thickness is related to the binder contents. Higher binder content compositions generally require thicker layers. Thicknesses outside these ranges can be selected if layers of greater thickness achieve the objectives of the present invention. The binders main purpose is a mechanical one—to hold the photogenerator substance together within the desired configuration of the total stack of layers of the photoreceptor. Since binders in general are electrical insulators, higher binder content photogenerator layers result in less spectral sensitivity that makes it necessary for stronger or more powerful light exposure and erase lamps, i.e. they become less light sensitive. At low binder contents some photogenerators become too conductive, that is it becomes impossible to hold a charge on the photoreceptor long enough even without exposure to light to make a useful photoreceptor, this type of discharge is called excessive dark decay. Since a modern copy machine cycle is measured seconds, some dark decay can be tolerated. It may be possible in some designs to reduce some dark decay by increasing the binder content.

Current generator coating formulae are usually dispersions of selenium or other photoconductors as described above in solutions of polymers. When the binder/generator layer (BGL) is coated, the solvents, which serve no further purpose once the coating is formed, must be removed by heating. The removal of solvents can result in increased air pollution. It is thus desirable to alternatively make coatings for BGLs by a process that either does not use any solvents or one that greatly reduces their use and as a result does not require solvent removal or only a minimal amount.

SUMMARY OF THE INVENTION

The process of the present invention either eliminates or significantly reduces the problems associated with prior art processes for BGL formulation and coating. The present invention includes dispersing photoconductive pigments into a reactive diluent(s), i.e., film forming monomer(s) that readily polymerize, and some solvent(s) if necessary for processing. The mixture may optionally be diluted with oligomers, which are active low molecular weight polymers. The diluent copolymerizes readily with an active site functionality of the polymer, and then becomes an integral part of the polymer by polymerization which can be accomplished by chemical treatment, heating, radiation and/or a combination of these. The radiation curing may be either ultraviolet (UV) or electron beam (EB). Autocatalysis is another possibility for curing such as with BZP, i.e., the photogenerator pigment has the ability to catalyze some vinyl monomers such as vinylbenzene/vinylpyrrol into a film when coated into a thin film approximately 0.0005" thick wet. The unique property about this system is that BZP dispersed into vinyl monomers can be mixed or roller milled with ⅛ stainless steel shot and no polymerization occurs; the dispersion has a long pot life and only has been observed to polymerize in thin films.

There are several advantages to the present invention in addition to avoiding the disadvantages the prior processes (e.g., dissolving polymers in solvents followed by the removal of the solvents). These advantages include:

1. Reduction or total elimination of solvent cost, i.e., all or most of the solvent would be replaced with liquid monomer(s)
2. Reduction or elimination of solvent recovery
3. Reduction or elimination of solvent air pollution
4. Elimination of a processing step, i.e., dissolving polymer in solvent
5. Vinyl monomers without dispersants or dissolved polymers have proved to be excellent dispersing media for pigments contrary to most volatile solvents and/or polymer/solvent systems.
6. Pigments can be dispersed in vinyl monomers in some cases with simple mixing, contrary to most polymer/solvent systems that require heavy duty attrition equipment that sometimes causes deleterious effects in the photogenerator
7. Vinyl monomer/pigment systems form stable dispersions that have less tendency to settle or separate that many polypher/solvent systems
8. Formulating latitude with monomers, can make special formulae to suit desired product simply by changing monomers or their ratios; for example, special adhesion promoter monomers may be included in a formulation to improve adhesion directly to a charge blocking layer without the need for a separate adhesion layer, this is not possible with polymer/solvent systems; another may be incorporation of an elastomer type of monomer to improve coating flexibility
9. Preproduction adjustment of each batch to meet tighter quality standards than is possible with prefixed polymer/solvent system
10. Decrease in cost due to the price differential between polymers and monomers

BRIEF DESCRIPTION OF THE FIGURES

The Figures summarize performance data for certain imaging members constructed in accordance with the present invention as described in certain examples below.

DETAILED DESCRIPTION OF THE INVENTION

Figure 1:
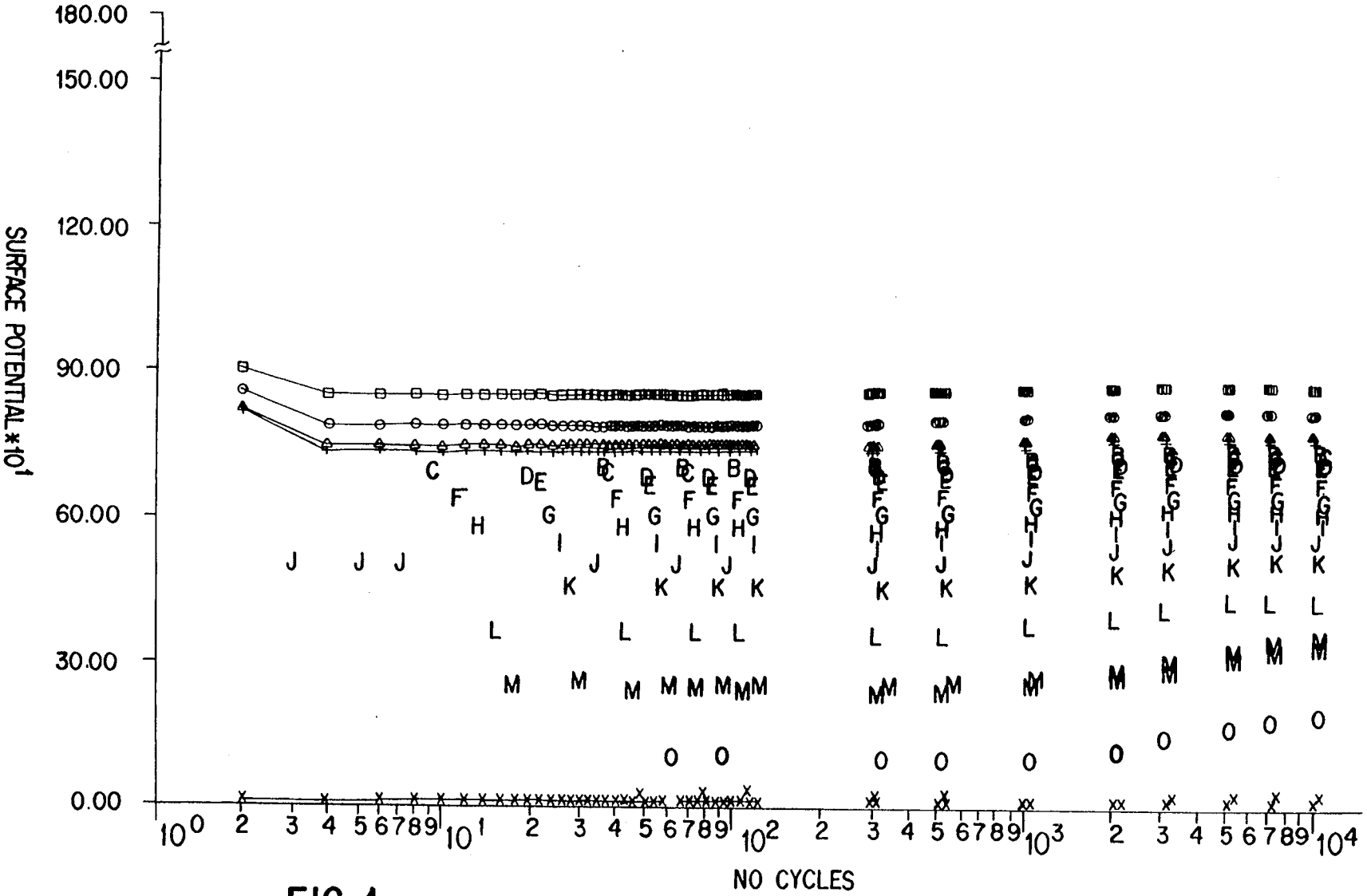
Figure 2:
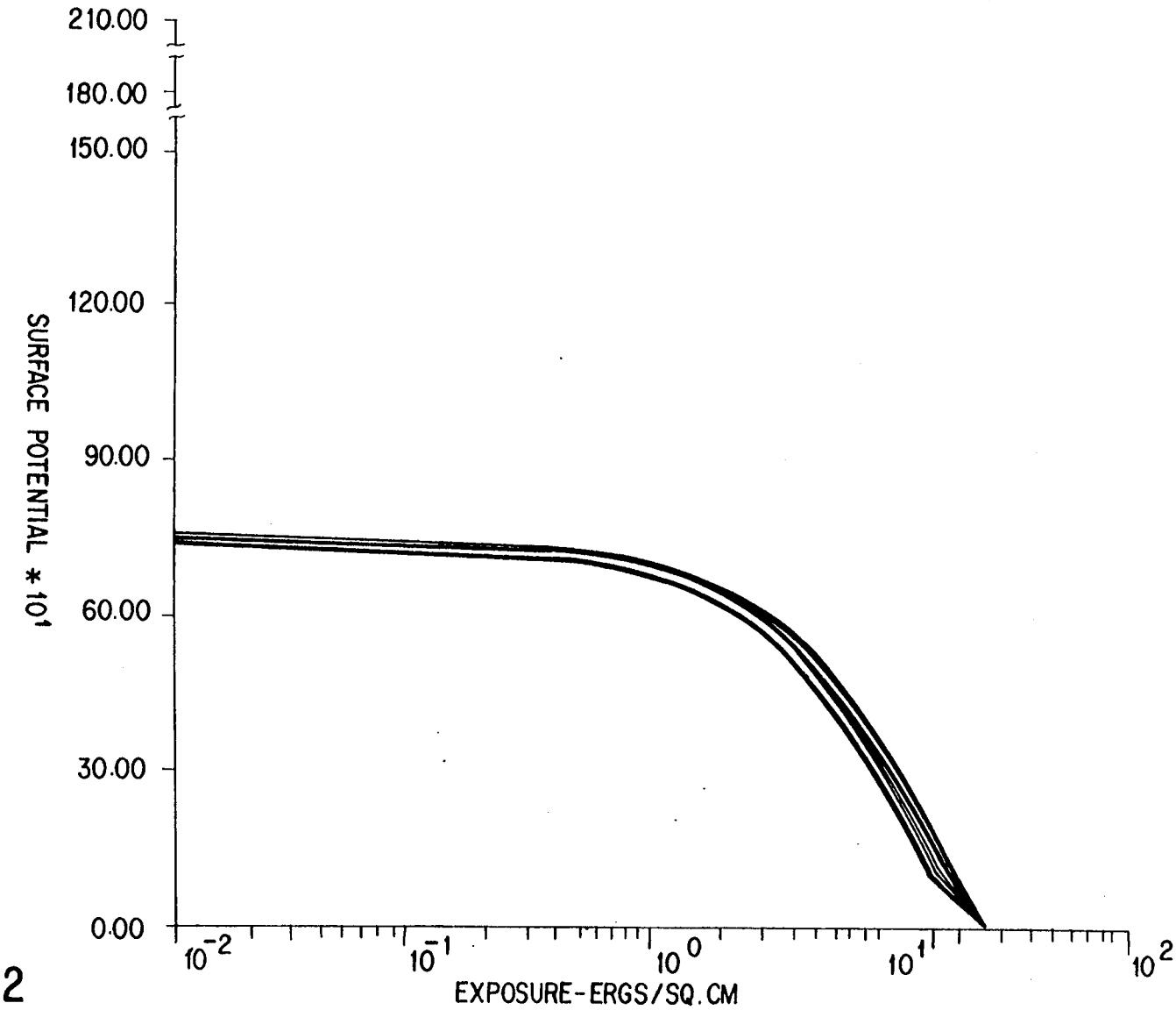

The use of film forming diluents instead of a polymer dissolved in a solvent should result in a closer contact between the pigment and the in situ polymer as compared to the polymer left after solvent removal. That is the polymer deposited from the solvent would leave voids between itself and the pigment from the shrinkage caused after the solvent leaves. In generator coatings these voids reduce conductivity and also impede light transmission by adding extra interface from which light might scatter. When a monomer is the diluent or a substantial part of it, the close contact it has with the pigment is never lost when In Situ polymerization is performed. Also monomers are mobile and able to fill voids left after the small amount of solvent is removed if some solvent was necessary. The freely moving monomers are free to rotate and fill any cracks or crevices of the pigment particles surfaces. Polymers on the other hand are hundreds or thousands of times larger than monomers and therefore do not have the mobility that monomers have and are frozen into place once the solvent is removed and as a result their residue cannot closely conform to the pigment surfaces.

The present invention is not limited by the choice of photoconductive material. Thus the photoconductive material used in the present invention may be selected from those previously described. Although any photoconductive material may be used in the present invention, photoconductive pigments such as benzimidazole perylene and vanadyl phthalocyanine are preferred.

The active diluents (monomers) can polymerize with oligomers to form complex polymers or they can polymerize with themselves to form linear polymers. The monomer/oligomer(s) may form thermoset type of polymers that are crosslinked and insoluble which could prevent solution of a BGL layer when it is coated on top of with a transport layer. The linear polymers formed may be homopolymers, copolymers, and/or terpolymers.

Further, reactive diluents, which are an intermediate product when compared to polymers, are less expensive than polymers they replace. The reactive diluent must be a film forming monomer, examples of which include: vinyl monomers, cyclic and alkaline, such as 4-vinylpyridine, vinylpyrrolidone (N-vinyl-2-pyrrolidone), vinyl benzene (styrene) and 5-vinyl-2-norbornene; and acrylate monomers such as cyclohexyl acrylate, diethoxyethylacrylate, diethylaminoethylacrylate, 2-ethylhexylacrylate, hydroxyethylacrylate, hydroxyethylmethacrylate, isobornylacrylate, phenoxyethylacrylate, ethyl acrylate, methyl methacrylate; and many other esters of acrylic acid where the alcohol reacting group can be propyl, butyl, etc.

The cyclic and alkaline monomers are preferred because they are almost electrically neutral to the BGL, i.e., they do not appear to have any adverse electrical interference. The interference could be charge trapping causing a cycle up effect where the background voltage increases and cannot be erased, another effect would be the polymer/photoconductor layer is too conductive in the dark, i.e., too much dark decay to hold the nominal charge necessary to develop an image. An extreme example of a bad polymer choice would one that totally inhibits any significant discharge when the device is exposed to light.

The oligomers are active low molecular weight polymers having active functional groups that can react further with active monomer diluents to form a cross linked polymer that is insoluble, and non thermoplastic. The functional sites may be sites of unsaturation, i.e., from an alkyd resin (unsaturated polyester oligomer) where the double bond comes from the maleic anhydride precursor of the oligomer. The diluent vinyl monomers such as styrene cross link to this unsaturation forming a thermoset resin. This resin is insoluble and non-thermoplastic unlike polymers of only monofunctional vinyl monomers. The addition of vinyl monomers in a small amount that have two vinyl groups per monomer to an all vinyl monomer system can also result in a cross linked polymer also. The classic example of this type of system of course would be styrene with as little as 0.01% of divinylbenzene in it, the product is no longer a thermoplastic and only swells in benzene because of crosslinking of the linear chains. The use of thermoset polymer BGLs allows for greater formulating latitude, that is, since they are insoluble there can be only insignificant, temporary physical changes when they are overcoated with transport layer dissolved in strong chlorinated solvents.

To form crosslinked polymers in situ, oligomers may be selected from, but, are not limited to urethane polyesters, polyethers, and epoxides.

Any suitable conventional technique may be used to reduce the photogenerator particles to the optimum submicron particle size and to produce a suitable mixture of the dispersion ingredients.

Any suitable and conventional technique for coating the photogenerating layer dispersion onto a substrate may be used. Typical application techniques include extrusion coating, Air Knife Coating, spin coating, spray coating, electrostatic spray coating, Bird Bar coating, etc. Once the coating is deposited it may be dried by any suitable conventional technique such as oven drying, infrared radiation drying, air drying, etc. The present invention allows for BZP dispersed into the monomer(s) to cure by autocatalysis to form either homopolymers or others such as copolymers or terpolymers. Alternatively, if accelerated polymerization is desired, free radical catalysts may be added and/or radiation, i.e., UV or EB may be employed. The indiscriminate addition of catalysts should be avoided because their residues may impair efficacy of the photoreceptor.

The present invention is illustrated by the following examples.

Examples 1–4: Formation of Photoconductive Dispersions

Example 1

Into a 50 ml flask the following was added 10 mls 5-vinyl-2-norbornene and 0.2g benzimidazole perylene. The mixture was agitated by a 1" Teflon coated magnet rotated to approximately 300 RPM by a Corning magnetic stirrer for about 3 hours. At that time, there was only a small amount of particles left undispersed on the flask bottom. The mixture agitated for 72 hours, followed by a standing period of 24 hours without agitation. The mixture was inspected and little settling of the BZP was discovered. The particle size of the dispersion was then analyzed with the Horiba CAPA-700 (centrifugal computerized particle size analyzer) and it determined that 81.7% of the BZP particles were less than 0.3 microns.

Example 2

The procedure of example 1 was repeated except that vinyl benzene was used instead of 5-vinyl-2-norbornene. In example 2, 93.2% of the BZP particles were less than 0.3 microns. Sub micron particle size is essential to achieve stable dispersions and give coatings for high resolution photoreceptors.

Example 3

The procedure of example 1 was repeated except 0.125 g of BZP was dispersed into 10 ml of vinyl pyrrolidone with mixing for 24 hours. No discernable pieces of BZP were on the bottom of the flask. The mixture then stood untouched for 24 hours, after which it was inspected and no appreciable settling was noticed.

Example 4

A BZP dispersion was prepared including the following ingredients:

| compound | density | batch | % w/w | mls | % v/v |
|---|---|---|---|---|---|
| BZP | 1.52 | 2.55 g | 9.25 | 1.68 | 6.3 |
| V-Pyrrol/ RC (GAF) | 1.04 | 10.0 g | 36.3 | 9.6 | 35.8 |
| styrene (Aldrich) | 0.909 | 15.0 g | 54.45 | 15.5 | 57.9 |

These ingredients were mixed in a 2 oz. brown bottle with 40ml of ⅛ inch #320 stainless steel shot and milled for 6 hours.

Example 5: Formation of Imaging Members Containing Dispersions

The BZP dispersion coatings of examples 1–4 were applied to a polyethylene terephthalate substrate precoated with a titanium ground plane that in turn had a silane blocking layer on it. The dispersion was coated directly on top of the blocking layer with a lab coater utilizing a 0.0005" Bird Bar. Polymerization of the coating occurred at room temperature by autocatalysis, that is it polymerized without addition of catalysts or radiation. A standard type of charge transport coating of dissolved polycarbonate and m-TBD (charge transport molecule) was then coated onto the BZP photogenerator layer. This layer was then oven dried at 110 degrees Centigrade for 10 minutes.

The imaging member formed from the dispersion of example 4 was then tested on a flat plate scanner and proved to have good charge acceptance and also a good discharge curve when exposed to light. Since this screening test was excellent, the imaging member was then submitted for rigorous 10,000 cycle testing on an automated scanner. The results presented in the Figures indicate that the imaging member demonstrated good photoconductivity without excessive dark decay, no residual voltage buildup, good charge acceptance and light sensitivity.

While the invention has been described with reference to specific embodiments, it will be apparent to those skilled in the art that many modifications and variations may be made. Accordingly, the present invention is intended to embrace all such alternatives, modifications and variations that may fall within the spirit and scope of the appended claims and equivalents thereof.

What is claimed is:

1. A process for preparing an electrophotographic imaging member comprising the steps of:

a) providing a supporting substrate having a conductive layer and a charge blocking layer;

b) coating said substrate with a film forming photoconductive dispersion comprising photoconductive particles made of benzimidazole perylene and a dispersion medium consisting essentially of a polymerizable film forming vinyl monomer;

c) polymerizing said photoconductive film forming dispersion by autocatalysis to form a charge generating layer; and d) forming a charge transport layer on top of said charge generating layer.

2. The process of claim 1 wherein said vinyl monomer is selected from the group consisting of cyclic vinyl monomers and alkaline vinyl monomers.

3. The process of claim 2 wherein said vinyl monomer is a cyclic vinyl monomer selected from the group consisting of 5-vinyl-2-norbornene and vinyl benzene.

4. The process of claim 2 wherein said vinyl monomer is an alkaline vinyl monomer selected from the group consisting of 4-vinylpyridine and vinyl pyrrolidone.

5. The process of claim 1 wherein said dispersion further comprises a reactive low molecular weight polymer.

6. The process of claim 5 wherein said polymer is selected from the group consisting of urethane polyesters, polyethers and epoxides.

* * * * *

UNITED STATES PATENT AND TRADEMARK OFFICE

CERTIFICATE OF CORRECTION

PATENT NO. : 5,332,644

DATED : July 26, 1994

INVENTOR(S) : Robert McNAMARA

It is certified that error appears in the above-indentified patent and that said Letters Patent is hereby corrected as shown below:

| Column | Line | Corrections |
|---|---|---|
| 4 | 23 | Change "polypher" to --polymer--. |
| 7 | 11 | Change "#320" to --#302--. |

Signed and Sealed this

Twenty-seventh Day of December, 1994

*Attest:*

Bruce Lehman

BRUCE LEHMAN

*Attesting Officer*

*Commissioner of Patents and Trademarks*